United States Patent [19]

Collins

[11] 4,331,108

[45] May 25, 1982

[54] RADIAL ENGINE

[76] Inventor: Brian S. Collins, Unit 35, 45 Leonard St., Victoria Park, Western Australia, Australia

[21] Appl. No.: 111,801

[22] Filed: Jan. 14, 1980

Related U.S. Application Data

[63] Continuation-in-part of Ser. No. 852,356, Nov. 17, 1977, abandoned.

[30] Foreign Application Priority Data

Nov. 18, 1976 [AU] Australia ..... 8181/76

[51] Int. Cl.[3] ..... F02B 59/00

[52] U.S. Cl. ..... 123/50 R; 123/41.35; 123/55 AA; 123/56 C; 123/65 S; 123/196 M

[58] Field of Search ..... 123/50, 55 R, 55 A, 123/55 AA, 65 A, 59 B, 59 S, 56 R, 56 A, 56 B, 56 AC, 56 BC, 56 C, 196 M, 65 S, 41.35

[56] References Cited

U.S. PATENT DOCUMENTS

| | | | |
|---|---|---|---|
| 883,374 | 5/1908 | Westendarp | 123/65 A |
| 1,702,686 | 2/1929 | Davis | 123/55 AA |
| 2,067,496 | 1/1937 | McCarthy | 123/50 R |
| 2,786,458 | 3/1957 | Luttrell | 123/50 R |

FOREIGN PATENT DOCUMENTS

| | | | |
|---|---|---|---|
| 466936 | 5/1974 | Australia | 123/50 R |
| 2743350 | 4/1979 | Fed. Rep. of Germany | 123/196 M |

*Primary Examiner*—Craig R. Feinberg
*Attorney, Agent, or Firm*—Harness, Dickey & Pierce

[57] ABSTRACT

An engine comprising; a substantially cylindrical housing; a rotor rotatably mounted in said housing on an axis parallel with the longitudinal central axis of the housing to execute an orbital motion within the housing, a plurality of tubular elements each slidably mounted over fixed piston elements projecting substantially inwardly from the housing; said tubular elements being closed at their inner ends and having their inner ends in slidable driving engagement with said rotor for causing reciprocation of the tubular elements over the piston elements upon rotation of the rotor; and the volume of the space defined by the interior of the tubular element and the piston element varying with the rotation of the rotor. The wall of the housing surrounding each side of each piston element defining an annular slot, and the side walls of the tubular element are sealingly and slidably engaged in the slot to form a pumping space between the walls of the tubular element and the sides of the slot of variable volume with the reciprocation of the tubular element. An air inlet port is formed in the housing in communication with said slot, and a port extends through the tubular element from said slot into the combustion space defined between the interior of the tubular element and the piston to pump air into that space. The rotor has a rotor duct therein opening onto the faces of the rotor adjacent the inner ends of the tubular elements, and the tubular elements have supply ducts formed therein opening at one end of the inner end such that they periodically communicate with the rotor duct on orbital rotation of the rotor, the other ends of the supply ducts opening into the faces of the tubular element which are in slidable engagement in the slot, the rotor duct being connected to a lubricant supply associated with the engines.

9 Claims, 2 Drawing Figures

RADIAL ENGINE

CROSS REFERENCE TO RELATED APPLICATION

This application is a continuation in part of my application entitled Improved Rotary Engine, Ser. No. 852,356, filed Nov. 17, 1977 now abandoned.

This invention relates to a rotary engine.

In particular the invention relates to an engine of the form disclosed in Australian Document No. 466936.

In one form the invention resides in a displacement engine comprising a substantially cylindrical housing, a rotor rotatably mounted in said housing on an axis parallel with the longitudinal central axis of the housing, a plurality of tubular elements each slidably mounted over fixed piston elements projecting substantially radially inwardly from the housing, said tubular elements being closed at their inner ends and held at their inner end in slidable and/or rolling engagement with the circumferential outer surface of the rotor, said rotor being such as to cause reciprocation of the tubular elements over the piston elements upon the rotation of the rotor, such that the volume of the space defined by the interior of the tubular member and the piston element varies with the rotation of the rotor; the wall of the housing surrounding each side of each piston element being such as to define a slot such that the side walls of the tubular element are sealingly and slidably engaged in the slot, wherein a pumping space formed between the walls of the tubular element and the sides of the slot being of variable volume with the reciprocation of the tubular element and being provided with a fluid inlet port in the housing and a port through the cylinder at least one of which, with the reciprocation of the tubular element, opens into the space defined between the interior of the tubular member and the piston to pump fluid into that space.

The invention will be more fully understood in the light of the following description of one specific embodiment. The description is made with reference to the accompanying drawings of which:

Figure 1:
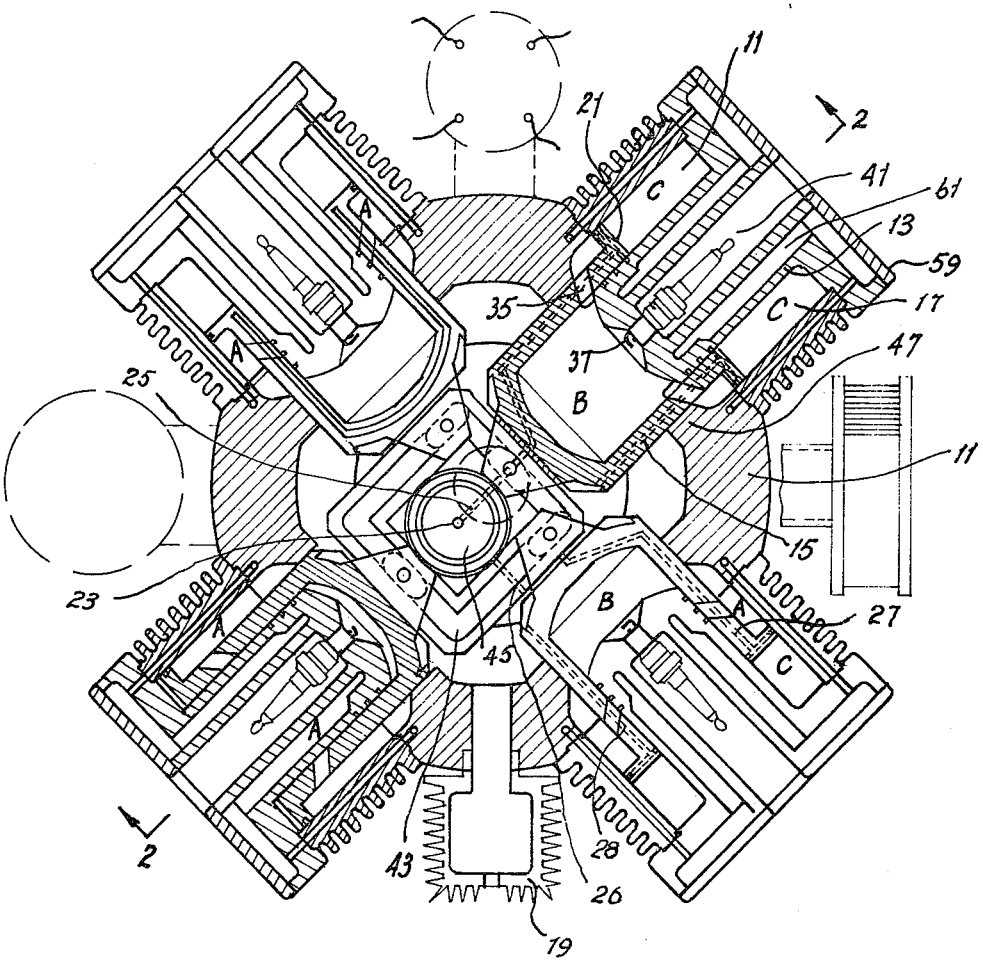
FIG. 1 is a sectional elevation of an engine according to the embodiment along line 1—1 of FIG. 2.

The embodiment shown in the drawings comprises a housing 11 having a number of circumferentially inwardly radially directed piston elements 13 mounted to its inner surface. Each piston element 13 has a cylinder 15 mounted thereon for sliding radial reciprocating movement on the piston element. The formation of the piston elements 13 in the housing 11 is such that the walls of the housing extend radially inwardly around the periphery of the piston element to define a slot 17 having the form of an annular cavity around the piston elements 13 and having the same transverse configuration as the piston element 13. The inner walls of the cylinder 15 are sealingly engaged on their inner curved surfaces by the piston element 13. The open end of the cylinders 15 are provided with outwardly extending flanges 21 which sealingly and slidably engage the outer wall of the slots 17.

The piston element 13 is formed such that it is separable from the casing and is provided with an axial passage for accommodating a spark plug 41 at its inner end. The electrodes of the spark plug have direct communication with the combustion chamber formed between the interior of the cylinder 15 and the piston 13. The axial passageway opens to the exterior of the piston to permit access to the spark plug for servicing.

The inner end of the cylinder 15 is slidably mounted to the periphery of a rotor 43 which is substantially square in shape and is rotatably mounted on an eccentric crankshaft 45 which is rotatably mounted in the casing on an axis substantially in alignment with the casings central longitudinal axis whereby with rotation of the crankshaft the rotor executes an orbital motion within the casings.

Figure 2:
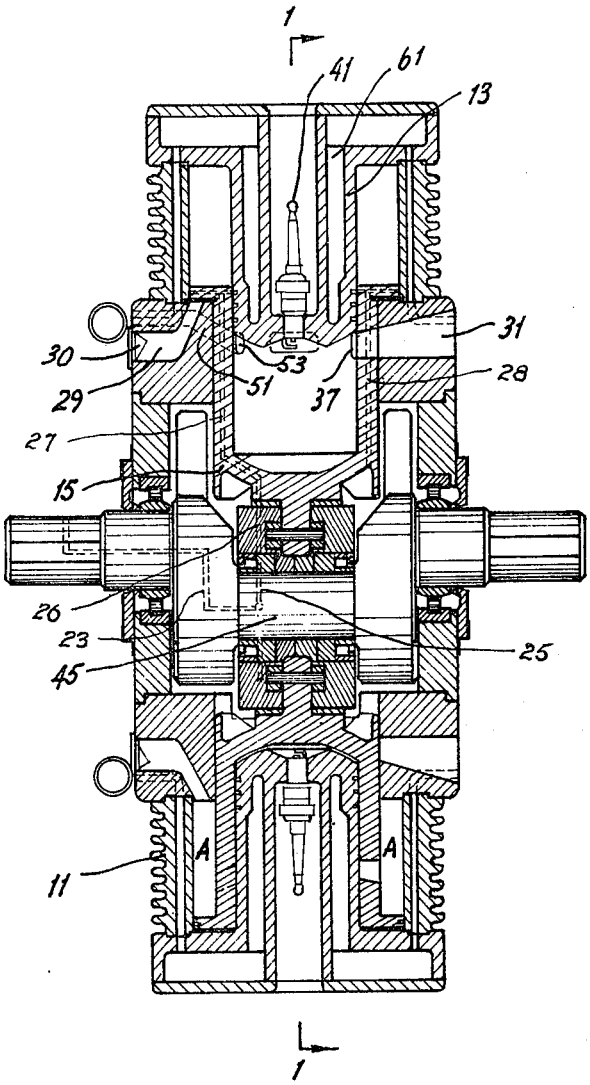
FIG. 2 is a sectional elevation along 2—2 of FIG. 1.

As mentioned the cylinders 15 are formed at their open ends with an outwardly directed annular flange 21, the outer edge of which sealingly engages the outer wall of the slot 17. At the upper end of the slot 17 the outer wall thereof at the region adjacent the top of the piston and above, has a reduced diameter portion 47 such that the outer walls of the cylinder 15 are sealingly engaged thereby. As a result the intermediate spaced A formed between the flange 21, the outer wall of the cylinder 15 and the reduced diameter portion 47 of the outer wall of the slot 17 is of variable volume as the cylinder 15 reciprocates in the slot 17. This intermediate space A is in communication with an air supply through a one way valve 30 and intake port 29 (see FIG. 2) and periodically with the interior of the combustion chamber B through a feed port 35 formed through the wall of the cylinder 15 (see FIG. 1). Such periodic communication occurs when the cylinder has approached almost the end of its upstroke, the intermediate space A is at its minimal volume and the combustion chamber B is at its maximum volume. The combustion chamber B exhausts the spent gases through a port 37 provided in the wall of the cylinder 15 and which also opens to an exhaust port 31 formed in the housing 11 when the cylinder 15 is approaching the end of its upstroke (see FIG. 2). A further port 53 is provided in the wall of the cylinder 15 which opens to a mating port 51 in the housing 11 when the cylinder is at the end of its upstroke.

Lubrication for the movement of cylinders 15 in the slots 17 and the sliding of the inner ends of the cylinders 15 on the rotor 43 is effected by a periodic supply of lubricant from an oil sump 19.

Lubricant for the engine is pumped from the oil sump 19, mounted to the underside of the casing, to an axial passage 23 formed in the crankshaft 45. The axial passage 23 opens into a radial passage 25 in the crankshaft which with rotation of the crankshaft 45 periodically communicates with four equally rotationally spaced radial passage ways 26 formed in the rotor 43 which in turn open onto one of the faces of the rotor 43. The opening of each radial passage 26 in the rotor is located such that with reciprocation of the cylinder 15 on the rotor the radial passage 25 periodically communicates with a further passage 27 formed in the cylinder which opens into the space between the adjacent surfaces of the cylinder 15 and the slot 17. A drainage passage 28 permits the drainage of lubricant into the rotor space and sump 19. The openings of the passageway 27 onto the opposed surfaces of the cylinder 15 and slot 17 comprise a series of openings spaced around both faces of the cylinder 15 and opening into a slot formed in both faces. The slot in both faces supports an oil ring (not shown) which controls the flow of lubricant such that only a thin film of lubricant is introduced onto the opposed faces of the cylinder 15 and slot 17. By means of this arrangement a supply of lubricant is delivered onto the opposed faces of the cylinder 15 and the slot 17 and between the opposed faces of the inner end of the cylinder 15 and the rotor 43.

The action of the motor will be described from a point where the volume of the combustion chamber B is at a minimum volume (i.e. ignition). During the expansion of the combustion chamber the space A defined between the walls and the flange 21 of the cylinder and the exterior wall of the slot 17 is reduced and the air which was introduced through the port 29 in the casing and one way valve 30 is compressed until, when the cylinder is at the lower reaches of its stroke the air is permitted to flow into the combustion chamber B from the space A just after the exhaust gases have been vented away through ports 37 and 31 in the cylinder and casing respectively. The entry of the air from the space A into the combustion chamber B serves to scavange the remaining exhaust gases from the combustion chamber while the cooling caused by the expansion of the air in the combustion chamber serves in cooling the combustion chamber. At the bottom of its downward stroke a quantity of fuel is injected into the combustion chamber B through ports 51 and 53 in the casing and cylinder respectively whereupon the cylinder begins its upward stroke to ignition and more air is drawn into the intake space A.

However while the invention has been described in terms of a two stroke cycle the engine is equally applicable to a four stroke cycle.

In order to reduce the problems of wear the interior cylindrical face of the cylinder may be provided with a wear resistant liner while the exterior face of the slot 17 which is in sliding engagement with the external face of the cylinder may also be provided with a wear resistant liner. The provision of such a liner facilitates the manufacture of the components by casting without the need for machining or hardening of faces of the components.

The piston 13 is removable via a head structure 59 which is separable from the casing 11. The head structure has formed within it, a cavity 61 for the flow of coolant through the head structure 59.

The space C defined in the slot 17 by the edge of the piston 13 is of variable volume with the reciprocation of the cylinder 15 over the piston 13. This space C may be used as a pumping space for pumping lubricant between the corresponding spaces of each cylinder. Alternatively this space C may be used as an air compressor to provide a forced air supply to the inlet port 29 for the air intake space A.

It should be appreciated that the scope of the invention need not be limited to the particular scope of the embodiment described herein. In addition the invention is applicable to any engine incorporating a reciprocating cylinder and static piston and need not be restricted to those of the form disclosed in Australian Pat. No. 466936.

I claim:

1. An engine comprising; a substantially cylindrical housing, a plurality of piston elements fixed to said housing and extending radially relative to the longitudinal central axis thereof, a rotor rotatably mounted in said housing on an axis parallel with said longitudinal central axis to execute an orbital motion within the housing, a plurality of tubular elements each slidably mounted over a respective of said fixed piston elements, said tubular elements being closed at their inner ends and having their inner ends in slidable driving engagement with said rotor for causing reciprocation of the tubular elements over the piston elements upon rotation of the rotor whereby the volume of the space defined by the interior of each of said tubular elements and the respective of said piston elements varying with the rotation of said rotor, a cylindrical wall of housing surrounding each of said piston elements being spaced therefrom to define an annular slot, a flange portion formed on each of said tubular elements sealingly and slidably engaged in said slot to form a pumping space between said flange portion of the tubular elements and the sides of the slot of variable volume with the reciprocation of said tubular element, an air inlet port formed in the housing in communication with each of said slots, a port extending through each of tubular elements from said slot into the combustion space defined between the interior of the respective tubular element and the respective piston to pump air into that space, said rotor having a rotor lubricant duct therein opening into the faces of the rotor adjacent the inner ends of the respective of said tubular elements, said tubular elements each having lubricant supply ducts formed therein and opening at one end thereof at the inner end such that they periodically communicate with said rotor lubricant duct on orbital rotation of said rotor, the other ends of said lubricant supply ducts opening into opposite faces of the respective flange portion of said tubular element which are in slidable engagement in the slot, said rotor duct being connected to a lubricant supply associated with the engines, and a lubricant return passage extending from opposite faces of said flange portion through each of said tubular elements to the interior of said housing for returning lubricant to said lubricant supply.

2. An engine as claimed in claim 1 wherein said rotor is rotatably received on a crankshaft and said rotor duct comprises an axial duct through said crankshaft periodically communicating with a set of radial ducts in the rotor extending between the crankshaft and the inner ends of the tubular element via at least one radial duct in the crankshaft.

3. An engine as claimed at claim 1 wherein the openings at the other end of the supply ducts open into a slot formed in each face of the tubular element and said slot accommodates an oil ring which controls the flow of lubricant onto the faces of the tubular element from the openings.

4. An engine as claimed at claim 1 wherein a set of exhaust ports are provided through the wall of the tubular element and a set of exhaust ports are provided in the housing, said ports communicating with each other when the combustion space between the interior of the tubular element and the piston is approaching its maximum volume.

5. An engine as claimed at claim 4 wherein a set of fuel inlet ports are provided in the wall of the tubular element and a set of fuel inlet ports are provided in the housing, said fuel inlet ports communicating with each other and with said combustion space when said combustion space begins to contract from its maximum volume for delivery of fuel thereto.

6. An engine as claimed at claim 1 wherein the cylindrical walls of the housing are each formed with a reduced diameter portion towards their radial inner ends in sliding sealing engagement with the exterior face of the respective tubular element to define a closed space between the respective flange and the respective reduced diameter portion, said closed space being said pumping space.

7. An engine as claimed at claim 6 wherein said pumping space is in permanent communication with the air inlet port, said air inlet port being connected to an air supply, said port being provided with a one-way valve to permit flow into the pumping space only.

8. An engine as claimed at claim 6 wherein the air intake port provided in the wall of the tubular element is periodically brought into communication with the pumping space with reciprocation of the tubular element otherwise said air intake port being blocked by the face of the reduced diameter portion of the slot.

9. An engine as claimed at claim 6 wherein the space between the inner end of the slot and the opposed end of the tubular element and opposed face of the flange defines a second pumping space.

* * * * *